US010330357B2

(12) United States Patent
Park et al.

(10) Patent No.: US 10,330,357 B2
(45) Date of Patent: Jun. 25, 2019

(54) AIR CONDITIONER AND COOLING RECEIVER OF AIR CONDITIONER

(71) Applicant: LG ELECTRONICS INC., Seoul (KR)

(72) Inventors: Sangil Park, Seoul (KR); Doyong Ha, Seoul (KR); Jaeheuk Choi, Seoul (KR); Yoonho Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 148 days.

(21) Appl. No.: 15/261,519

(22) Filed: Sep. 9, 2016

(65) Prior Publication Data

US 2017/0074559 A1 Mar. 16, 2017

(30) Foreign Application Priority Data

Sep. 11, 2015 (KR) ..... 10-2015-0129284

(51) Int. Cl.

| | |
|---|---|
| ***F25B 1/00*** | (2006.01) |
| ***F25B 40/02*** | (2006.01) |
| ***F25B 7/00*** | (2006.01) |
| ***F25B 13/00*** | (2006.01) |
| ***F28F 9/02*** | (2006.01) |

(Continued)

(52) U.S. Cl.

CPC ..... *F25B 40/02* (2013.01); *F25B 1/00* (2013.01); *F25B 7/00* (2013.01); *F25B 13/00* (2013.01); *F28D 7/103* (2013.01); *F28D 7/106* (2013.01); *F28D 7/16* (2013.01); *F28F 9/0234* (2013.01); *F25B 2313/0233* (2013.01); *F25B 2400/053* (2013.01); *F25B 2400/16* (2013.01); *F25B 2400/22* (2013.01); *F25B 2400/24* (2013.01)

(58) Field of Classification Search

CPC .... F25B 40/02; F25B 1/00; F25B 7/00; F25B 13/00; F25B 2313/0233; F25B 2339/044; F25B 2400/053; F25B 2400/16; F25B 2400/22; F25B 2400/24; F28D 7/103; F28D 7/106; F28D 7/16; F28F 9/0234

USPC ..... 62/335

See application file for complete search history.

(56) References Cited

U.S. PATENT DOCUMENTS

| | | | | |
|---|---|---|---|---|
| 4,947,655 | A * | 8/1990 | Shaw | F25B 1/10 62/200 |
| 2002/0148239 | A1* | 10/2002 | Trieskey | F25B 5/02 62/79 |
| 2014/0014300 | A1 | 1/2014 | Hwang et al. | |

FOREIGN PATENT DOCUMENTS

| | | | |
|---|---|---|---|
| CN | 1590931 | A | 3/2005 |
| EP | 2 615 392 | A2 | 7/2013 |
| GB | 1 520 276 | A | 8/1978 |

(Continued)

*Primary Examiner* — Joseph F Trpisovsky

(74) *Attorney, Agent, or Firm* — Dentons US LLP

(57) ABSTRACT

An air conditioner in which a supercooler and a receiver are integrated and the cooling receiver of the air conditioner. The cooling receiver of an air conditioner includes a cooling unit configured to include at least one first refrigerant flow channel through which a refrigerant flows and a second refrigerant flow channel which surrounds the outer circumference of part of the at least one first refrigerant flow channel and through which a refrigerant flows and supercools a refrigerant flowing through the first refrigerant flow channel and a receiver unit configured to have at least one end of the cooling unit disposed in the receiver unit and to store the supercooled refrigerant exiting from the first refrigerant flow channel.

9 Claims, 9 Drawing Sheets

(51) Int. Cl.
*F28D 7/10* (2006.01)
*F28D 7/16* (2006.01)

(56) References Cited

FOREIGN PATENT DOCUMENTS

| | | | |
|---|---|---|---|
| JP | 10-103800 | A | 4/1998 |
| JP | 2000-283583 | A | 10/2000 |
| JP | 2005-106366 | A | 4/2005 |

* cited by examiner

AIR CONDITIONER AND COOLING RECEIVER OF AIR CONDITIONER

CROSS-REFERENCE TO RELATED APPLICATION

The application claims priority under 35 U.S.C. § 119 and 35 U.S.C. § 365 to Korean Patent Application No. 10-2015-0129284, filed Sep. 11, 2015, whose entire disclosure is hereby incorporated by reference.

BACKGROUND OF THE INVENTION

1. Field of the Invention

An air conditioner and a cooling receiver of the air conditioner and, more particularly, an air conditioner that supercools and stores a liquid refrigerant and a cooling receiver of the air conditioner.

2. Description of the Related Art

An air conditioner is an apparatus for cooling or heating the interior of a room using an air-conditioning cycle including a compressor, an outside (also referred to as outdoor) heat exchanger, an expansion device, and an inside (also referred to as indoor) heat exchanger. The air conditioner may include a cooling unit for cooling the interior of a room and a heating unit for heating the interior of a room. Furthermore, the air conditioner may be a combined cooling and heating air conditioner for cooling or heating the interior of a room.

The combined cooling and heating air conditioner generally includes a cooling/heating switching valve for changing the flow channel of a refrigerant compressed by a compressor depending on a cooling operation and a heating operation. When a cooling operation is performed, the refrigerant compressed by the compressor flows into the outside heat exchanger through the cooling/heating switching valve. The outside heat exchanger functions as a condenser. The refrigerant condensed by the outside heat exchanger is expanded by the expansion device and then flows into the inside heat exchanger. In this case, the inside heat exchanger functions as an evaporator. The refrigerant evaporated by the inside heat exchanger flows into the compressor again through the cooling/heating switching valve.

When a heating operation is performed, the refrigerant compressed by the compressor flows into the inside heat exchanger through the cooling/heating switching valve. The inside heat exchanger functions as a condenser. The refrigerant condensed by the inside heat exchanger is expanded by the expansion device and then flows into the outside heat exchanger. As such, the outside heat exchanger functions as an evaporator. The refrigerant evaporated by the outside heat exchanger flows into the compressor again through the cooling/heating switching valve.

The combined cooling and heating air conditioner may include a plurality of inside units each having an inside heat exchanger may. Only some of the plurality of inside units may operate as a partial load. If only some of connected inside units operate, a refrigerant of a low-pressure gas state is present within the inside heat exchanger of the stopped inside unit. If the refrigerant is sealed by taking into consideration the number of connected inside units, then the refrigerant of an inside unit that does not operate transfers to the outside heat exchanger, which changes a refrigerant circulation state. Accordingly, the optimal amount of a refrigerant may not be distributed to the air-conditioning cycle.

Furthermore, when the heating operation is performed, the functions of the outside heat exchanger and inside heat exchanger of the air conditioner are changed. A ratio of the volumes of the outside heat exchanger and inside heat exchanger is changed depending on the number of connected inside units. Furthermore, it is necessary to control the amount of a refrigerant in response to a change in cooling/heating operation mode.

Accordingly, a receiver in which a refrigerant is stored is installed on the air-conditioning cycle to optimize the amount of the refrigerant of the air-conditioning cycle. The receiver functions to transfer a refrigerant stored therein to the air-conditioning cycle when the amount of the refrigerant of the air-conditioning cycle is insufficient and functions to store the refrigerant of the air-conditioning cycle when the amount of the refrigerant of the air-conditioning cycle is excessive, so the amount of the refrigerant of the air-conditioning cycle becomes an optimal amount. Also, the air conditioner may include a supercooler to supercool a refrigerant that has passed through the outside heat exchanger when the cooling operation is performed. The supercooler, disposed between the outside heat exchanger and the inside heat exchanger, functions as an intercooler.

Recently, complex type air conditioners are being installed in locations, such as supermarkets. More particularly, the complex type air conditioner integrates an air-conditioning cycle circuit for air-conditioning the interior of a room and a refrigeration cycle circuit for refrigerating a low-temperature storage unit (such as a display case for storing food at a low temperature). In the complex type air conditioner, the supercooler supercools a refrigerant that has passed through the condenser of the refrigeration cycle circuit and overheats a refrigerant that has passed through the condenser of the air-conditioning cycle circuit. This is done by thermally exchanging the refrigerant passing through the condenser of the refrigeration cycle circuit and the refrigerant passing through the condenser of the air-conditioning cycle circuit. However, such conventional air conditioners are problematic because installation space is limited. Moreover, because the receiver and the supercooler are separately formed, the structure is complicated and costly due to the configuration of refrigerant pipes for forming the receiver and the supercooler into a cycle circuit, and refrigeration efficiency is low.

SUMMARY OF THE INVENTION

An object of the present disclosure is to provide an air conditioner in which a supercooler and a receiver are integrated, and a cooling receiver of the air conditioner.

Object of the present disclosure are not limited to the aforementioned object, and those skilled in the art may evidently understand other objects not described above from the following description.

An air conditioner according to an embodiment of the present disclosure includes an air-conditioning cycle circuit configured to have a refrigerant to circulate through a first compressor, a first condenser, a first expansion device, and a first evaporator, a refrigeration cycle circuit configured to have a refrigerant to circulate through a second compressor, a second condenser, a second expansion device, and a second evaporator, and a cooling receiver configured to thermally exchange a refrigerant passed through the second condenser and a refrigerant passed through the first condenser and to store the thermally exchanged refrigerant. The cooling receiver includes a cooling unit configured to include at least one first refrigerant flow channel through which the refrigerant passed through the second condenser flows and a second refrigerant flow channel which surrounds the outer circumference of part of the at least one first refrigerant flow channel and through which the refrigerant passed through the first condenser flows and supercools the refrigerant flowing through the first refrigerant flow channel, and a receiver unit configured to have at least one end of the cooling unit disposed in the receiver unit and to store the supercooled refrigerant exiting from the first refrigerant flow channel.

Furthermore, a cooling receiver of an air conditioner according to an embodiment of the present disclosure includes a cooling unit configured to include at least one first refrigerant flow channel through which a refrigerant flows and a second refrigerant flow channel which surrounds the outer circumference of part of the at least one first refrigerant flow channel and through which a refrigerant flows and supercools a refrigerant flowing through the first refrigerant flow channel and a receiver unit configured to have at least one end of the cooling unit disposed in the receiver unit and to store the supercooled refrigerant exiting from the first refrigerant flow channel.

Details of other embodiments are included in the detailed description and drawings.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Advantages and features of the present disclosure and methods for achieving the merits and characteristics will be more clearly understood from embodiments described in detail later in conjunction with the accompanying drawings. However, the present disclosure is not limited to the disclosed embodiments, but may be implemented in various different ways. The embodiments are provided to only complete the disclosure of the present disclosure and to allow a person having ordinary skill in the art to which the present disclosure pertains to completely understand the category of the invention. The present disclosure is only defined by the category of the claims. The same reference numbers are used to refer to the same or similar elements throughout the specification.

Hereinafter, an air conditioner and a cooling receiver of the air conditioner according to embodiments of the present disclosure are described in detail with reference to the accompanying drawings.

Figure 1:
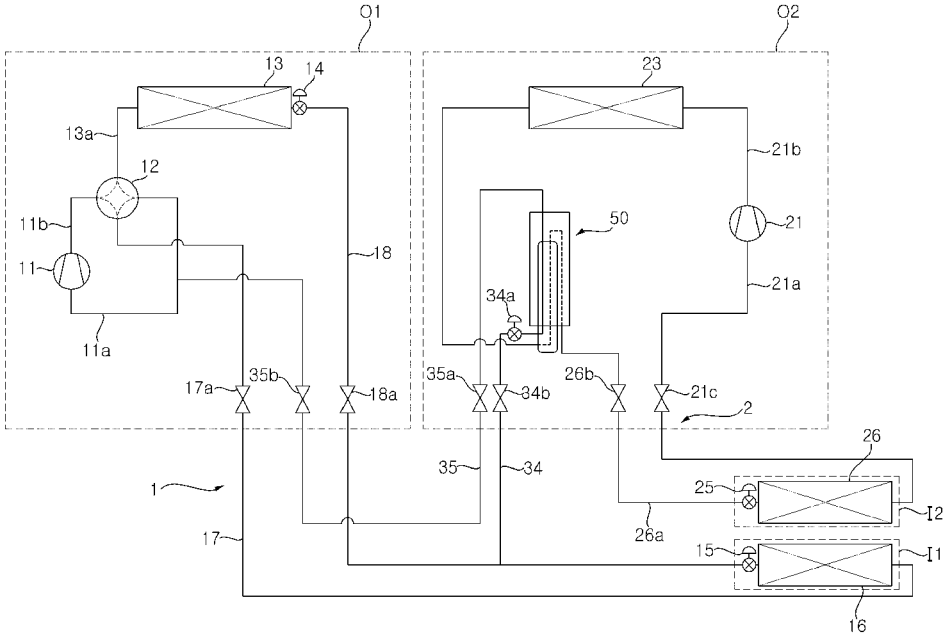
FIG. 1 is a configuration diagram showing an air conditioner according to an embodiment of the present disclosure.

FIG. 1 is a configuration diagram showing an air conditioner according to an embodiment of the present disclosure. Referring to FIG. 1, the air conditioner includes an air-conditioning cycle circuit 1 and a refrigeration cycle circuit 2. The air-conditioning cycle circuit 1 may include an air-conditioning outside unit O1 (also referred to as outdoor unit O1) that is installed outsides and an air-conditioning inside unit I1 (also referred to as an air-conditioning indoor unit I1) that is installed inside. The refrigeration cycle circuit 2 may include a refrigeration outside unit O2 that is installed outside and a refrigeration inside unit I2 (also referred to as a refrigeration inside unit I2) that is installed indoors. The air-conditioning cycle circuit 1 may air-condition (or cool/heat) the interior of a room. The refrigeration cycle circuit 2 may refrigerate (or cool/freeze) food stored in the refrigeration inside unit I2.

First, the air-conditioning cycle circuit 1 is described below.

The air-conditioning cycle circuit 1 may include a first compressor 11, an outside heat exchanger 13 (also referred to as outdoor heat exchanger 13), a first expansion device 14, 15, and an inside heat exchanger 16 (also referred to as an indoor heat exchanger 16).

In the air-conditioning cycle circuit 1, when a cooling operation is performed, a refrigerant may circulate in order of the first compressor 11, the outside heat exchanger 13, the first expansion device 14, 15, the inside heat exchanger 16, and the first compressor 11. In the air-conditioning cycle circuit 1, when the cooling operation is performed, the outside heat exchanger 13 may function as a first condenser, and the inside heat exchanger 16 may function as a first evaporator.

Furthermore, in the air-conditioning cycle circuit 1, when a heating operation is performed, a refrigerant may circulate in order of the first compressor 11, the inside heat exchanger 16, the first expansion device 14, 15, the outside heat exchanger 13, and the first compressor 11. In the air-conditioning cycle circuit 1, when the heating operation is performed, the outside heat exchanger 13 may function as a first evaporator, and the inside heat exchanger 16 may function as a first condenser.

The air-conditioning cycle circuit 1 may further include a cooling/heating switching valve 12 configured to enable a refrigerant to circulate through the first compressor 11, the outside heat exchanger 13, the first expansion device 14, 15, and the inside heat exchanger 16 when a cooling operation is performed, and configured to enable a refrigerant to circulate through the first compressor 11, the inside heat exchanger 16, the first expansion device 14, 15, and the outside heat exchanger 13 when a heating operation is performed.

The first compressor 11 may suction (e.g., suck) a refrigerant, may compress the refrigerant, and may then discharge the compressed refrigerant. A plurality of the first compressors 11 may be connected in parallel or in series. A suction flow channel 11*a* through which a refrigerant is suctioned into the first compressor 11 may be connected to the first compressor 11. A discharge flow channel 11*b* through which a compressed refrigerant is discharged from the first compressor 11 may be connected to the first compressor 11. If a plurality of the first compressors 11 are connected in parallel, the suction flow channel 11*a* may likewise be connected in parallel to the plurality of first compressors 11, and the discharge flow channel 11*b* may likewise be connected in parallel to the plurality of first compressors 11.

The outside heat exchanger 13 may operate as the first condenser in which a refrigerant compressed by the first compressor 11 is condensed when a cooling operation is performed. The outside heat exchanger 13 may operate as the first evaporator in which a refrigerant expanded by the first expansion device 14, 15 is evaporated when a heating operation is performed. The outside heat exchanger 13 may include an air-refrigerant heat exchanger configured to thermally exchange an outside air and a refrigerant. The outside heat exchanger 13 may include a water-cooling heat exchanger configured to thermally exchange heat source water, such as water or an antifreezing solution, and a refrigerant.

The first expansion device 14, 15 includes an outside expansion valve 14 (also referred to as an outdoor expansion valve 14) and an inside expansion valve 15 (also referred to as an indoor expansion valve 15). The outside expansion valve 14 may be installed between the inside expansion valve 15 and the outside heat exchanger 13, and may be installed closer to the outside heat exchanger 13 than to the inside heat exchanger 16. The outside expansion valve 14 may not expand a refrigerant when a cooling operation is performed, but may expand a refrigerant when a heating operation is performed. The outside expansion valve 14 may be fully open upon cooling, and may be controlled to a set opening degree upon heating. The outside expansion valve 14 may be installed on a bypass pipe installed on a refrigerant pipe between the outside heat exchanger 13 and the inside expansion valve 15.

A check valve configured to enable a refrigerant to flow into the inside expansion valve 15 when a cooling operation is performed and to enable a refrigerant to flow into the outside expansion valve 14 by blocking the refrigerant when a heating operation is performed may be installed on the refrigerant pipe between the outside heat exchanger 13 and the inside expansion valve 15. The inside expansion valve 15 may be installed between the outside heat exchanger 13 and the inside heat exchanger 16, and may be installed proximately closer to the inside heat exchanger 16 than to the outside heat exchanger 13.

The inside heat exchanger 16 may function as the first evaporator in which a refrigerant expanded by the first expansion device 14, 15 is evaporated when a cooling operation is performed. The inside heat exchanger 16 may function as a first condenser in which a refrigerant compressed by the first compressor 11 is condensed when a heating operation is performed.

The cooling/heating switching valve 12 may be a 4-way valve. For example, the cooling/heating switching valve 12 may be connected to the first compressor 11 through the suction flow channel 11*a* of the first compressor 11, may be connected to the first compressor 11 through the discharge flow channel 11*b* of the first compressor 11, may be connected to the outside heat exchanger 13 through the suction/discharge flow channel 13*a* of the outside heat exchanger 13, and may be connected to the inside heat exchanger 16 through an air conditioner pipe 17.

Furthermore, the outside heat exchanger 13 and the inside heat exchanger 16 may be connected through an air-conditioning liquid line 18.

An air conditioner pipe valve 17*a* configured to open/shut the air conditioner pipe 17 may be installed on the air conditioner pipe 17. An air-conditioning liquid line valve 18*a* configured to open/shut air-conditioning liquid line 18 may be installed on the air-conditioning liquid line 18.

The air-conditioning cycle circuit 1 may further include a first accumulator (not shown) installed between the cooling/heating switching valve 12 and the first compressor 11. The first accumulator may be installed on the suction flow channel 11*a* of the first compressor 11. Accordingly, a refrigerant that flows from the cooling/heating switching valve 12 to the first compressor 11 may flow into the first accumulator. A liquid refrigerant of the refrigerant that has flowed into the first accumulator may be accumulated in the first accumulator, and a gaseous refrigerant of the refrigerant that has flowed into the first accumulator may be suctioned into the first compressor 11.

The refrigeration cycle circuit 2 is described below.

The refrigeration cycle circuit 2 may include a second compressor 21, a second condenser 23, a second expansion device 25, and a second evaporator 26.

In the refrigeration cycle circuit 2, a refrigerant may circulate in order of the second compressor 21, the second condenser 23, the second expansion device 25, the second evaporator 26, and the second compressor 21.

The second compressor 21 may compress the suctioned refrigerant, and may discharge the compressed refrigerant. A plurality of the second compressors 21 may be connected in parallel or in series. A suction flow channel 21*a* through which a refrigerant is suctioned into the second compressor 21 may be connected to the second compressor 21. A discharge flow channel 21*b* through which a refrigerant compressed by the second compressor 21 is discharged may be connected to the second compressor 21. If a plurality of the second compressors 21 are connected in parallel, the suction flow channel 21*a* may likewise be connected in parallel to the plurality of second compressors 21, and the discharge flow channel 21*b* may likewise be connected in parallel to the plurality of second compressors 21.

The second condenser 23 condenses a refrigerant compressed by the second compressor 21. The second condenser 23 may include an air-refrigerant heat exchanger configured to thermally exchange an outside air and a refrigerant. The second condenser 23 may include a water-cooling heat exchanger configured to thermally exchange heat source water, such as water or an antifreezing solution, and a refrigerant.

The second expansion device 25 expands a refrigerant that enters into the second evaporator 26. The second expansion device 25 may be installed between the second condenser 23 and the second evaporator 26, and may be installed proximately closer to the second evaporator 26 than to the second condenser 23.

The second evaporator 26 may evaporate a refrigerant (for example, while refrigerating food stored in the refrigeration inside unit I2) by thermally exchanging the refrigerant expanded by the second expansion device 25 and an air within the refrigeration inside unit I2.

The second compressor 21 may be connected to the second evaporator 26 through the suction flow channel 21*a*. The second compressor 21 may be connected to the second condenser 23 through the discharge flow channel 21*b*. The second condenser 23 and the second evaporator 26 may be connected through the suction flow channel 26*a* of the second evaporator 26.

A first suction flow channel valve 21*c* configured to open/shut the suction flow channel 21*a* may be installed on the suction flow channel 21*a* of the second compressor 21. A second suction flow channel valve 26*b* configured to open/shut a suction flow channel 26*a* may be installed on the suction flow channel 26*a* of the second evaporator 26.

The refrigeration cycle circuit 2 may further include a second accumulator (not shown) installed between the second evaporator 26 and the second compressor 21. The second accumulator may be installed on the suction flow channel 21*a* of the second compressor 21. Accordingly, a refrigerant flowing from the second evaporator 26 to the second compressor 21 may flow into the second accumulator, a liquid refrigerant of the refrigerant that has flowed into the second accumulator may be accumulated in the second accumulator, and a gaseous refrigerant of the refrigerant that has flowed into the second accumulator may be suctioned into the second compressor 21.

The air conditioner according to an embodiment of the present disclosure may further include a cooling receiver 50 configured to thermally exchange a refrigerant that has passed through the second condenser 23 and a refrigerant that has passed through one of the outside heat exchanger 13 and the inside heat exchanger 16, which functions as the first condenser.

The cooling receiver 50 is described in detail below.

Figure 2:
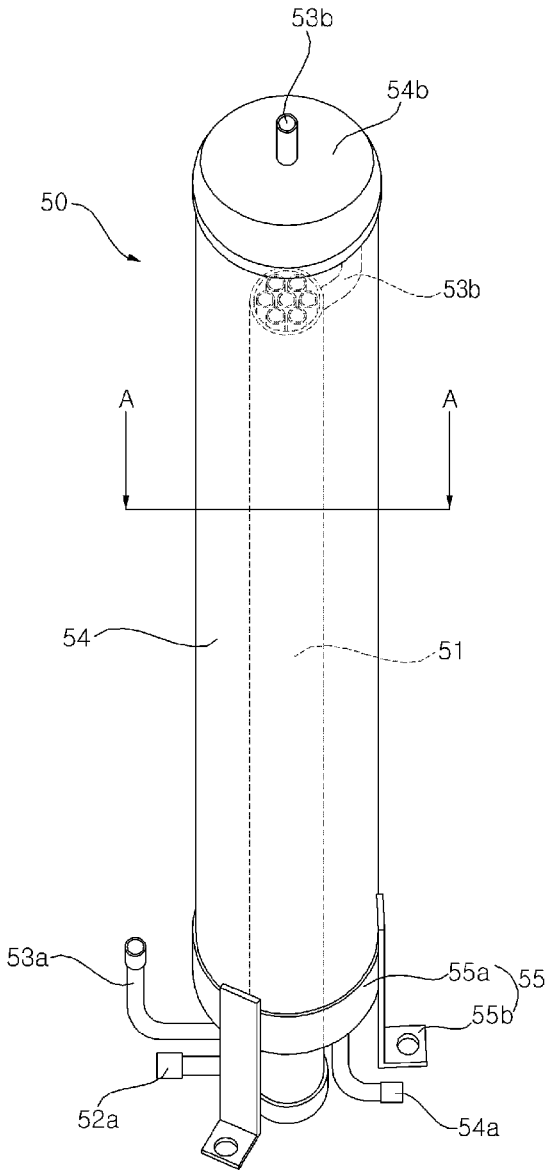
FIG. 2 is a detailed view of a cooling receiver shown in FIG. 1.
Figure 3:
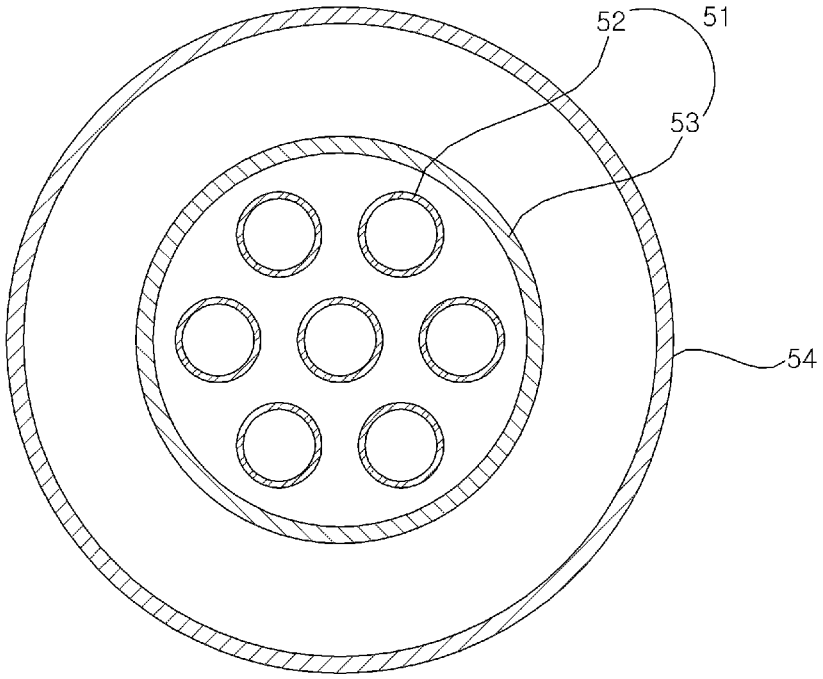
FIG. 3 is a cross-sectional view of the cooling receiver taken along line A-A of FIG. 2.

FIG. 2 is a detailed view of the cooling receiver shown in FIG. 1. FIG. 3 is a cross-sectional view of the cooling receiver taken along line A-A of FIG. 2.

Referring to FIGS. 1, 2, and 3, the cooling receiver 50 includes a cooling unit 51 and a receiver unit 54 in which at least one end of the cooling unit 51 is disposed.

The cooling unit 51 includes at least one first refrigerant flow channel 52 through which a refrigerant that has passed through the second condenser 23 flows and a second refrigerant flow channel 53 configured to surround the outer circumference of some of the at least one first refrigerant flow channel 52. A refrigerant that has passed through one of the outside heat exchanger 13 and the inside heat exchanger 16, which functions as the first condenser, is thermally exchanged with a refrigerant flowing through the first refrigerant flow channel 52 while flowing through the inside of the second refrigerant flow channel 53. Accordingly, the refrigerant flowing through the first refrigerant flow channel 52 is supercooled, and the refrigerant flowing through the second refrigerant flow channel 53 is gasified.

At least one end of the cooling unit 51 is disposed in the receiver unit 54, and a supercooled refrigerant exiting from the first refrigerant flow channel 52 is stored in the receiver unit 54.

As shown, the cooling unit 51 and the receiver unit 54 may be formed to have a cylindrical shape. The diameters of the first refrigerant flow channel 52, the second refrigerant flow channel 54, and the receiver unit may be sized relative to each other. For example, the diameter of the first refrigerant flow channel 52 may be the smallest, the diameter of the second refrigerant flow channel 53 may be larger than that of the first refrigerant flow channel 52, and the diameter of the receiver unit 54 may be larger than that of the second refrigerant flow channel 53. The first refrigerant flow channel 52, as shown, may be formed of seven thin-necked pipes.

The cooling unit 51 may have an upper end inserted and disposed in the receiver unit 54 and a lower end protruded to the lower side of the receiver unit 54, such that the lower end may be exposed to the outside of the receiver unit 54.

In the cooling unit 51, the first refrigerant flow channel 52 having the upper end disposed within the receiver unit 54 is open, and the second refrigerant flow channel 53 is shut. The open upper end of the first refrigerant flow channel 52 may be protruded upward from the upper end of the second refrigerant flow channel 53. Accordingly, a refrigerant flowing through the first refrigerant flow channel 52 may be supercooled through a thermal exchange with a refrigerant flowing through the second refrigerant flow channel 53. Next, the supercooled refrigerant may exit from the open upper end of the first refrigerant flow channel 52 and may be stored in the internal space of the receiver unit 54.

A first inlet flow channel 52*a* and a second inlet flow channel 53*a* may be disposed at a portion that belongs to the cooling unit 51 and that is protruded toward the lower side of the receiver unit 54. A first outlet flow channel 53*b* may be disposed at the upper side of the receiver unit 54, and a second outlet flow channel 54*a* may be disposed at the lower side of the receiver unit 54.

The first inlet flow channel 52*a* may be connected to the first refrigerant flow channel 52 through the second refrigerant flow channel 53. The first inlet flow channel 52*a* thus supplies the first refrigerant flow channel 52 with a refrigerant that has passed through the second condenser 23. In configurations in which the second refrigerant flow channel 53 includes a plurality of the first refrigerant flow channels 52, the first inlet flow channel 52*a* may branch into a plurality of the first inlet flow channels within the second refrigerant flow channel 53 and then connect with the plurality of first refrigerant flow channels 52.

The second inlet flow channel 53*a* may be connected to the second refrigerant flow channel 53. The second inlet flow channel 53*a* thus supplies the second refrigerant flow channel 53 with a refrigerant that has passed through one of the outside heat exchanger 13 and the inside heat exchanger 16, which functions as the first condenser. The second refrigerant flow channel 53 may be connected to the air-conditioning liquid line 18 through a heat recovery liquid line 34 branched from the air-conditioning liquid line 18 that connects the second outside heat exchanger 13 and the inside heat exchanger 16. That is, the heat recovery liquid line 34 connects the second refrigerant flow channel 53 and the air-conditioning liquid line 18.

A heat recovery expansion device 34*a* may be installed on the heat recovery liquid line 34. Accordingly, some of a refrigerant that has passed through the first condenser may flow to the first evaporator through the air-conditioning liquid line 18. The remainder of the refrigerant may flow to the heat recovery liquid line 34, may be expanded by the heat recovery expansion device 34*a*, and may then flow to the second inlet flow channel 53*a*. The refrigerant that has flowed to the second inlet flow channel 53*a* may be supplied to the second refrigerant flow channel 53.

The first outlet flow channel 53*b* may be connected to the upper part of the second refrigerant flow channel 53 within the receiver unit 54 through the upper end of the receiver unit 54. Accordingly, a refrigerant supplied to the second refrigerant flow channel 53 through the second inlet flow channel 53*a* may pass through the second refrigerant flow channel 53 and then exit through the first outlet flow channel 53*b*. The first outlet flow channel 53*b* protruded to the upper end of the receiver unit 54 may be connected to the suction flow channel 11*a* of the first compressor 11 through the heat recovery line 35. Accordingly, the refrigerant that has exited through the first outlet flow channel 53*b* may flow to the suction flow channel 11*a* of the first compressor 11 through the heat recovery line 35, and may be supplied to the first compressor 11.

The second outlet flow channel 54*a* may be connected to the suction flow channel 26*a* of the second evaporator 26. Accordingly, a supercooled refrigerant that has exited through the upper end of the first refrigerant flow channel 52 and has stored in the receiver unit 54 may exit through the second outlet flow channel 54*a*, may flow to the suction flow channel 26*a* of the second evaporator 26, and may be then supplied to the second evaporator 26.

A cap 54*b* configured to cover the upper end of the receiver unit 54 may be disposed at the upper end of the receiver unit 54. If the cap 54*b* is so disposed, the first outlet flow channel 53*b* may penetrate the cap 54*b*.

At least one mounting bracket 55 may be disposed at the lower part of the receiver unit 54. For example, the mounting bracket 55 may include a ring-shaped main body unit 55*a* configured to surround the outer circumferential surface of the receiver unit 54 and a plurality of mounting units 55*b* disposed on the outer circumferential surface of the main body unit 55*a* and spaced apart from each other at an equal distance or interval. The three mounting units 55*b* may be included in the mounting bracket 55. The mounting unit 55*b* may be mounted on the refrigeration outside unit O2, thus coupling the receiver unit 54 to the refrigeration outside unit O2.

A heat recovery liquid line valve 34*b* configured to open/shut the heat recovery liquid line 34 may be installed in the heat recovery liquid line 34. Heat recovery line valves 35*a* and 35*b* configured to open/shut the heat recovery line 35 may be installed on the heat recovery line 35. The heat recovery line valves 35*a* and 35*b* include a first heat recovery line valve 35*a* disposed in the refrigeration outside unit O2 and a second heat recovery line valve 35*b* disposed in the air-conditioning outside unit O1.

The air conditioner pipe valve 17*a*, the air-conditioning liquid line valve 18*a*, the first suction flow channel valve 21*c*, the second suction flow channel valve 26*b*, the heat recovery liquid line valve 34*b*, and the heat recovery line valves 35*a* and 35*b* may be open at normal times and may be shut by a user when a service (e.g., the filling of a refrigerant or a failure) is performed on the air conditioner.

The first compressor 11, the four-way valve 12, the outside heat exchanger 13, the outside expansion valve 14, the air conditioner pipe valve 17*a*, the air-conditioning liquid line valve 18*a*, and the second heat recovery line valve 35*b* may be included in the air-conditioning outside unit O1.

The second compressor 21, the second condenser 23, the cooling receiver 50, the first suction flow channel valve 21*c*, the second suction flow channel valve 26*b*, the heat recovery liquid line valve 34*b*, and the first heat recovery line valve 35*a* may be included in the refrigeration outside unit O2.

The inside heat exchanger 16 and the inside expansion valve 15 may be included in the air-conditioning inside unit I1. Furthermore, the second evaporator 26 and the second expansion device 25 may be included in the refrigeration inside unit I2.

Operations of the air conditioner configured as described above according to embodiments of the present disclosure are described below.

Figure 4:
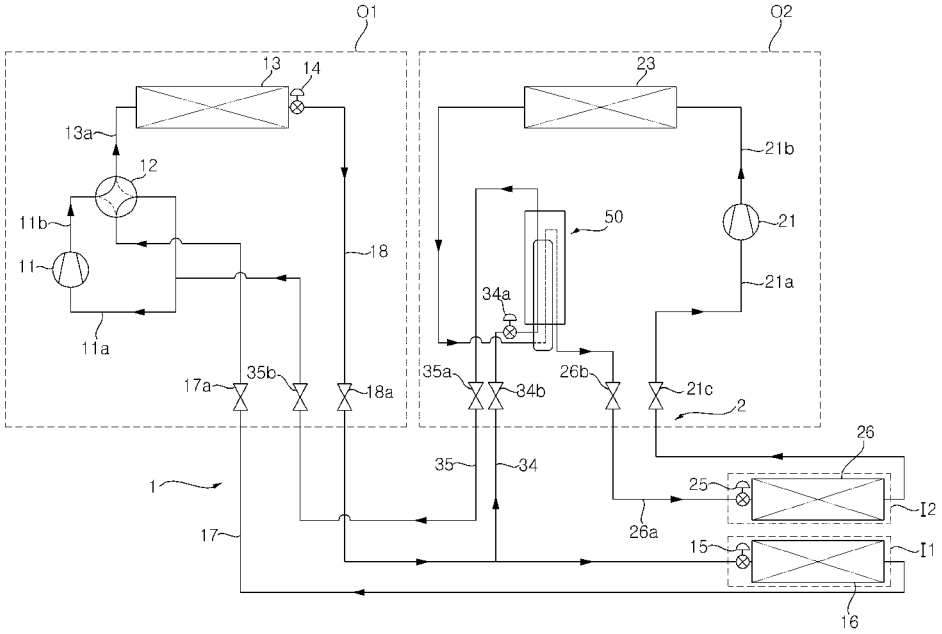
FIG. 4 is a diagram showing a flow of a refrigerant when the cooling operation and refrigeration operation of the air conditioner are performed at the same time according to an embodiment of the present disclosure.

FIG. 4 is a diagram showing a flow of a refrigerant when the cooling operation and refrigeration operation of the air conditioner are performed at the same time according to an embodiment of the present disclosure.

Referring to FIG. 4, the air conditioner may simultaneously perform a cooling operation for cooling the interior of a room and a refrigeration operation for refrigerating food within the refrigeration inside unit I2. That is, for example, when the cooling operation of the air-conditioning cycle circuit 1 is performed, the first compressor 11 is driven and the air-conditioning cycle circuit 1 discharges a refrigerant.

The refrigerant discharged by the first compressor 11 flows to the cooling/heating switching valve 12 through the discharge flow channel 11*b* of the first compressor 11. The refrigerant that has flowed to the cooling/heating switching valve 12 flows to the outside heat exchanger 13 through the suction/discharge flow channel 13*a* of the outside heat exchanger 13. When the cooling operation of the air-conditioning cycle circuit 1 is performed, the outside heat exchanger 13 functions as the first condenser.

Some of the refrigerant that has passed through the outside heat exchanger 13 moves to the inside heat exchanger 16 through the air-conditioning liquid line 18. The remainder of the refrigerant that has passed through the outside heat exchanger 13 flows to the cooling receiver 50 through the heat recovery liquid line 34.

Some of the refrigerant that passes through the outside heat exchanger 13 and that flows to the inside heat exchanger 16 through the air-conditioning liquid line 18 is supplied to the inside heat exchanger 16 when the refrigerant has been expanded by the first expansion device 15. When the cooling operation of the air-conditioning cycle circuit 1 is performed, the inside heat exchanger 16 functions as the first evaporator. The refrigerant that has flowed to the inside heat exchanger 16 may refrigerate air within a room and may be evaporated, while it is thermally exchanged with the air within the room. The refrigerant evaporated by the inside heat exchanger 16 may flow to the cooling/heating switching valve 12 through the air conditioner pipe 17, and may be then supplied to the first compressor 11 again through the suction flow channel 11*a* of the first compressor 11.

The refrigeration cycle circuit 2 may drive the second compressor 21 and discharge a refrigerant. The refrigerant discharged by the second compressor 21 may flow to the second condenser 23 through the discharge flow channel 21*b* of the second compressor 21. The refrigerant that has flowed to the second condenser 23 may flow to the second evaporator 26 through the suction flow channel 26*a* of the second evaporator 26.

The refrigerant that has passed through the second condenser 23 may be supplied to the second evaporator 26 when the refrigerant has been expanded by the second expansion device 25. The refrigerant that has flowed to the second evaporator 26 may refrigerate food within the refrigeration inside unit I2 and may be evaporated, while it is thermally exchanged with air within the refrigeration inside unit I2. The refrigerant evaporated by the second evaporator 26 may be supplied to the second compressor 21 again through the suction flow channel 21*a* of the second compressor 21.

The remaining of the refrigerant that passes through the outside heat exchanger 13 of the air-conditioning cycle circuit 1 and has flowed to the cooling receiver 50 through the heat recovery liquid line 34 may be expanded by the heat recovery expansion device 34*a*, may flow to the second refrigerant flow channel 53, and may be gasified through a thermal exchange with the refrigerant that has passed through the second condenser 23 of the refrigeration cycle circuit 2 within the cooling receiver 50 while supercooling the refrigerant that has passed through the second condenser 23.

The cooling receiver 50 may be installed between the second condenser 23 and the second expansion device 25 on the suction flow channel 26*a* of the second evaporator 26. The refrigerant that has passed through the second condenser 23 may be thermally exchanged with the refrigerant flowing through the second refrigerant flow channel 53 and supercooled, while it flows through the first refrigerant flow channel 52.

The refrigerant supercooled while flowing through the first refrigerant flow channel 52 may exit through the open upper end of the first refrigerant flow channel 52, and may be then stored in the receiver unit 54. The refrigerant gasified while flowing through the second refrigerant flow channel 53 may exit from the first outlet flow channel 53*b*, flow to the suction flow channel 11*a* of the first compressor 11 through the heat recovery line 35, and then be supplied to the first compressor 11. Furthermore, the supercooled refrigerant stored in the receiver unit 54 may exit through the second outlet flow channel 54*a*, flow to the suction flow channel 26*a* of the second evaporator 26, and then be supplied to the second evaporator 26 in the state in which the refrigerant has been expanded by the second expansion device 25. At least one of the opening degree time and opening degree amount of the second expansion device 25 may be controlled by a controller (not shown) so that there is an optimal amount of refrigerant within the refrigeration cycle circuit 2.

Figure 5:
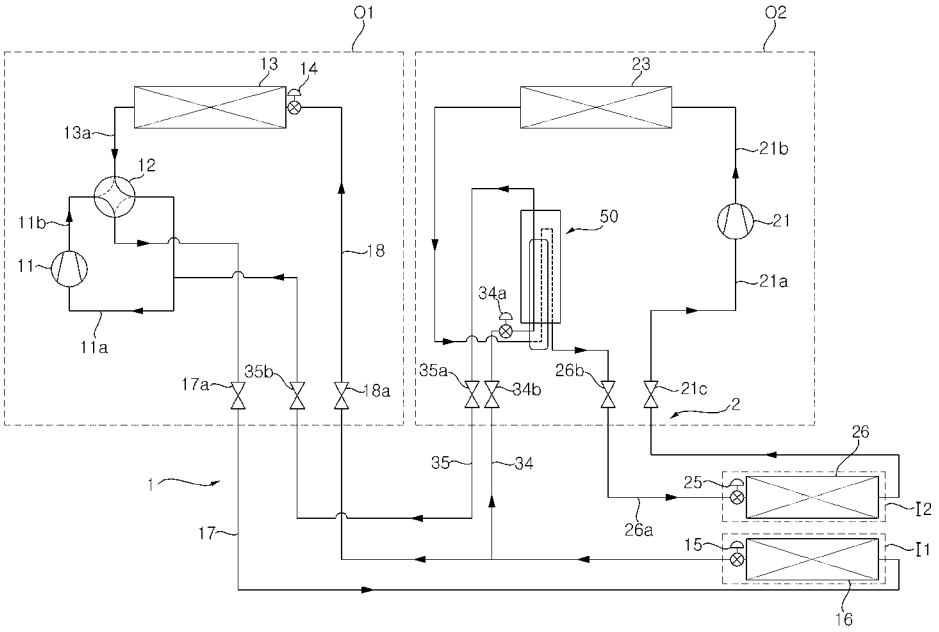
FIG. 5 is a diagram showing a flow of a refrigerant when the heating operation and refrigeration operation of the air conditioner are performed at the same time according to an embodiment of the present disclosure.

FIG. 5 is a diagram showing a flow of a refrigerant when the heating operation and refrigeration operation of the air conditioner are performed at the same time according to an embodiment of the present disclosure.

Referring to FIG. 5, the air conditioner may simultaneously perform a heating operation for heating the interior of a room and a refrigeration operation for refrigerating food within the refrigeration inside unit I2.

That is, when the heating operation of the air-conditioning cycle circuit 1 is performed, the first compressor 11 may be driven and the air-conditioning cycle circuit 1 may discharge a refrigerant. The refrigerant discharged by the first compressor 11 may flow to the cooling/heating switching valve 12 through the discharge flow channel 11*b* of the first compressor 11. The refrigerant that has flowed to the cooling/heating switching valve 12 may flow to the inside heat exchanger 16 through the air conditioner pipe 17. Thus, when the heating operation of the air-conditioning cycle circuit 1 is performed, the inside heat exchanger 16 functions as the first condenser.

Some of the refrigerant that has passed through the inside heat exchanger 16 may flow to the outside heat exchanger 13 through the air-conditioning liquid line 18. The remainder of the refrigerant that has passed through the inside heat exchanger 16 may flow to the cooling receiver 50 through the heat recovery liquid line 34.

Some of the refrigerant passing through the inside heat exchanger 16 and that flows to the outside heat exchanger 13 through the air-conditioning liquid line 18 may be supplied to the outside heat exchanger 13 when the refrigerant has been expanded by the first expansion device 14. Thus, when the heating operation of the air-conditioning cycle circuit 1 is performed, the outside heat exchanger 13 functions as the first evaporator. The refrigerant that has flowed to the outside heat exchanger 13 may be evaporated while it is thermally exchanged with outside air. The refrigerant evaporated by the outside heat exchanger 13 may flow to the cooling/heating switching valve 12 through the suction/discharge flow channel 13*a* of the outside heat exchanger 13, and may be supplied to the first compressor 11 again through the suction flow channel 11*a* of the first compressor 11.

In the refrigeration cycle circuit 2, the second compressor 21 may be driven, and the refrigeration cycle circuit 2 may discharge a refrigerant. The refrigerant discharged by the second compressor 21 may flow to the second condenser 23 through the discharge flow channel 21*b* of the second compressor 21. The refrigerant that has flowed to the second condenser 23 may flow to the second evaporator 26 through the suction flow channel 26*a* of the second evaporator 26.

The refrigerant that has passed through the second condenser 23 may be supplied to the second evaporator 26 when the refrigerant has been expanded by the second expansion device 25. Thus, the refrigerant that has flowed to the second evaporator 26 may refrigerate food within the refrigeration inside unit I2 and may be evaporated, while it is thermally exchanged with air within the refrigeration inside unit I2. The refrigerant evaporated by the second evaporator 26 may be supplied to the second compressor 21 again through the suction flow channel 21*a* of the second compressor 21.

The remaining refrigerant that belongs to the refrigerant passing through the inside heat exchanger 16 of the air-conditioning cycle circuit 1 and that has flowed to the cooling receiver 50 through the heat recovery liquid line 34 may be expanded by the heat recovery expansion device 34*a*, may flow to the second refrigerant flow channel 53, and may be gasified through a thermal exchange with the refrigerant that has passed through the second condenser 23 of the refrigeration cycle circuit 2 within the cooling receiver 50 while supercooling the refrigerant that has passed through the second condenser 23.

Furthermore, the refrigerant that has passed through the second condenser 23 may be supercooled through a thermal exchange with the refrigerant flowing through the second refrigerant flow channel 53, while flowing through the first refrigerant flow channel 52. The refrigerant supercooled while flowing through the first refrigerant flow channel 52 may exit through the open upper end of the first refrigerant flow channel 52 and be stored in the receiver unit 54. The refrigerant gasified while flowing through the second refrigerant flow channel 53 may exit from the first outlet flow channel 53*b*, flow to the suction flow channel 11*a* of the first compressor 11 through the heat recovery line 35, and be supplied to the first compressor 11 The supercooled refrigerant stored in the receiver unit 54 may exit from the second outlet flow channel 54*a*, flow to the suction flow channel 26*a* of the second evaporator 26, and be supplied to the second evaporator 26 when the refrigerant has been expanded by the second expansion device 25. At least one of the opening degree time and opening degree amount of the second expansion device 25 may be controlled by the controller (not shown) so that there is an optimal amount of refrigerant within the refrigeration cycle circuit 2.

Figure 6:
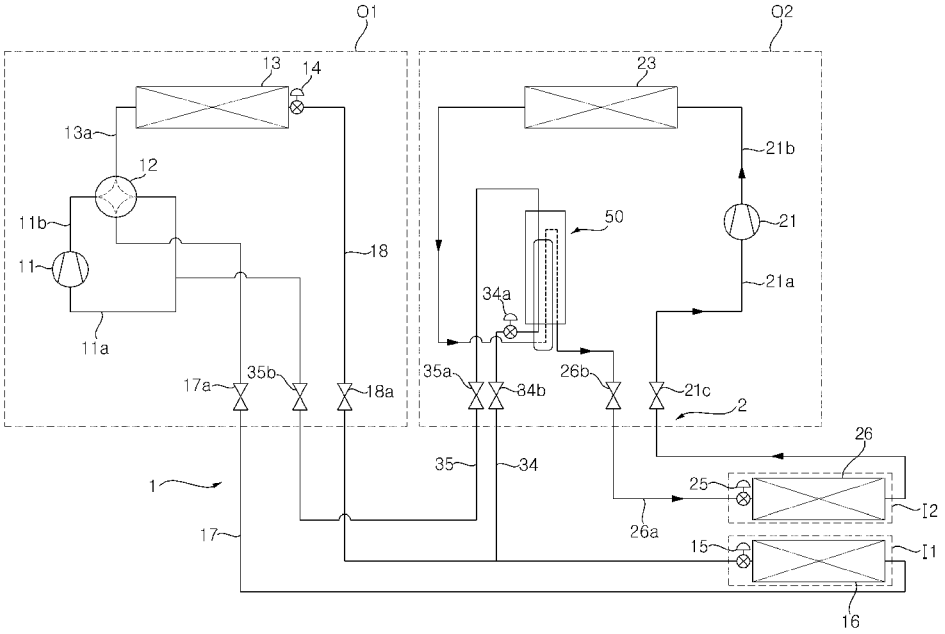
FIG. 6 is a diagram showing a flow of a refrigerant when only the refrigeration operation of the air conditioner is performed according to an embodiment of the present disclosure.

FIG. 6 is a diagram showing a flow of a refrigerant when only the refrigeration operation of the air conditioner is performed according to an embodiment of the present disclosure.

Referring to FIG. 6, the air conditioner may perform only a refrigeration operation for refrigerating food within the refrigeration inside unit I2. That is, only the refrigeration cycle circuit 2 may operate.

The second compressor 21 of the refrigeration cycle circuit 2 may be driven, and the refrigeration cycle circuit 2 may discharge a refrigerant. The refrigerant discharged by the second compressor 21 may flow to the second condenser 23 through the discharge flow channel 21*b* of the second compressor 21. The refrigerant that has flowed to the second condenser 23 may flow to the second evaporator 26 through the suction flow channel 26*a* of the second evaporator 26.

The refrigerant that has passed through the second condenser 23 may be supplied to the second evaporator 26 when the refrigerant has been expanded by the second expansion device 25. Thus, the refrigerant that has flowed to the second evaporator 26 may refrigerate food within the refrigeration inside unit I2 and may be evaporated while it is thermally exchanged with air within the refrigeration inside unit I2. The refrigerant evaporated by the second evaporator 26 may be supplied to the second compressor 21 again through the suction flow channel 21*a* of the second compressor 21.

Furthermore, since the air-conditioning cycle circuit 1 does not operate, the refrigerant that has passed through the second condenser 23 is not thermally exchanged while flowing through the first refrigerant flow channel 52. Instead, the refrigerant may exit through the open upper end of the first refrigerant flow channel 52 and be stored in the receiver unit 54. The stored refrigerant may exit through the second outlet flow channel 54*a*, flow to the suction flow channel 26*a* of the second evaporator 26, and be supplied to the second evaporator 26 when the refrigerant has been expanded by the second expansion device 25. At least one of the opening degree time and opening degree amount of the second expansion device 25 may be controlled by the controller (not shown) so that there is an optimal amount of a refrigerant within the refrigeration cycle circuit 2.

Figure 7:
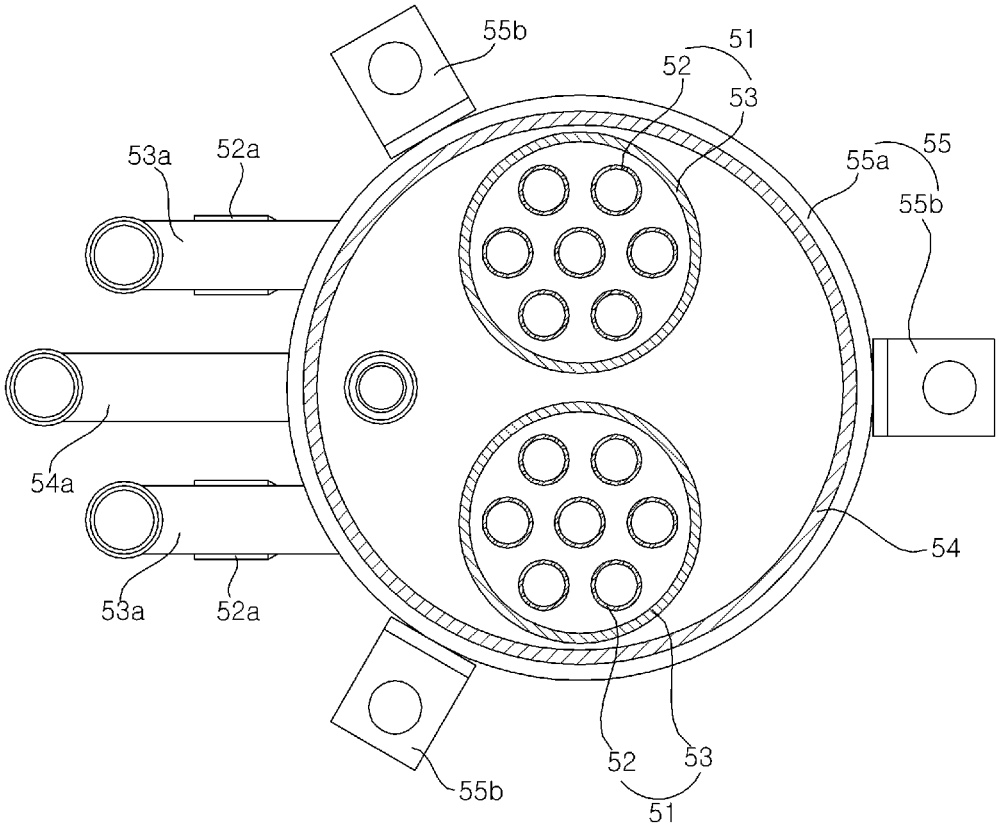
FIG. 7 is a plan sectional view showing another embodiment of the cooling receiver.
Figure 8:
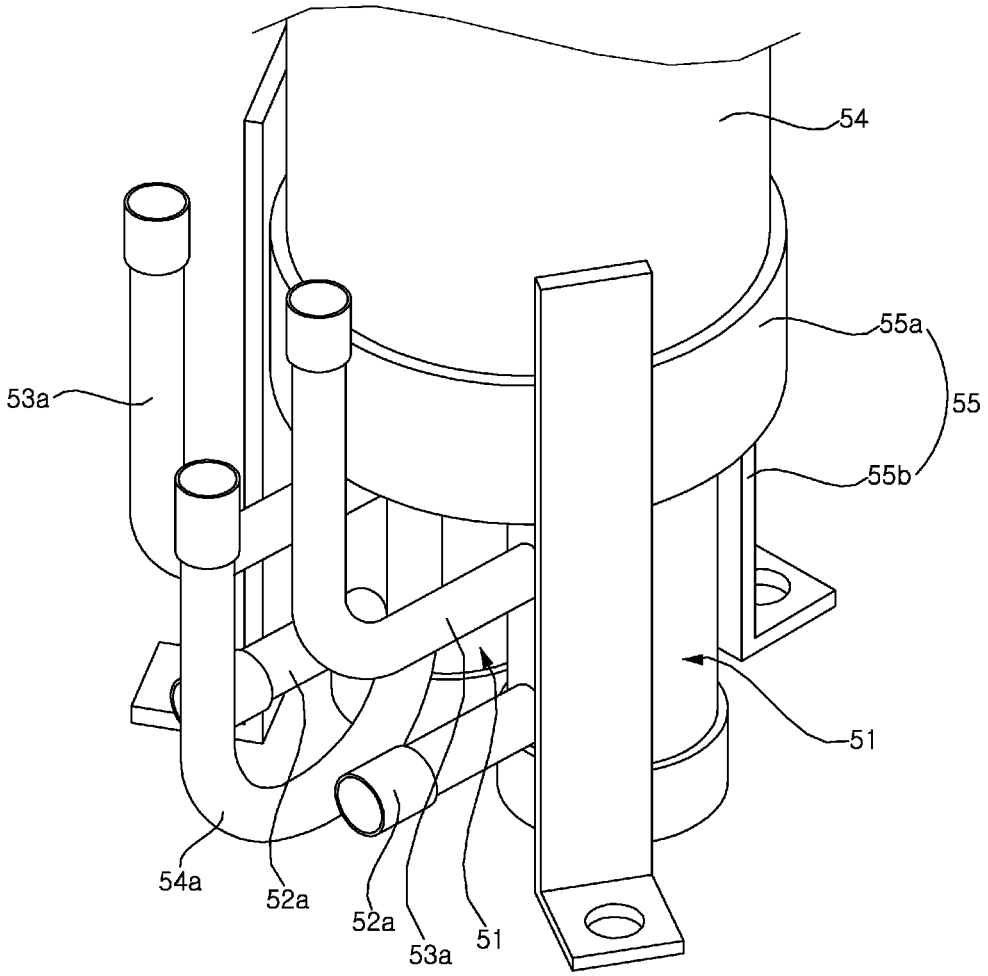
FIG. 8 is a perspective view showing the lower part of the cooling receiver shown in FIG. 7.
Figure 9:
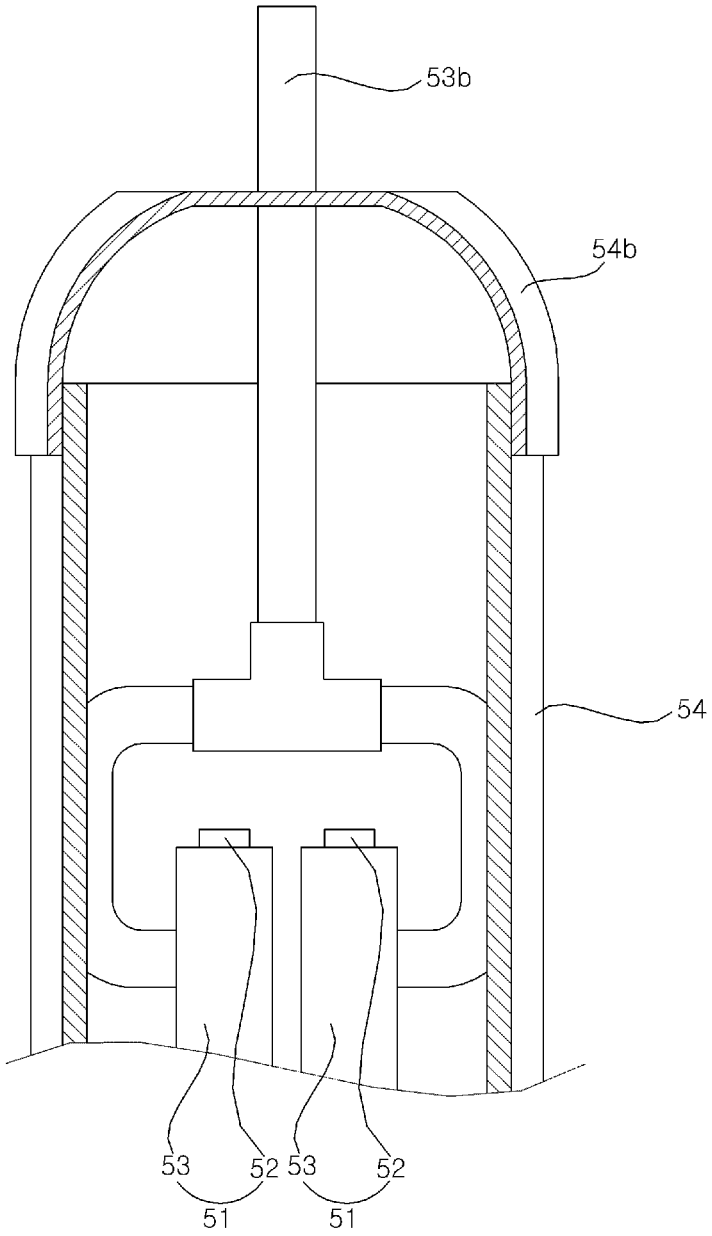
FIG. 9 is a perspective view showing the upper part of the cooling receiver shown in FIG. 7.

FIG. 7 is a plan sectional view showing another embodiment of the cooling receiver. FIG. 8 is a perspective view showing the lower part of the cooling receiver shown in FIG. 7. FIG. 9 is a perspective view showing the upper part of the cooling receiver shown in FIG. 7. Regarding the embodiment illustrated in FIGS. 7-9, for purposes of convenience, the same reference numerals are assigned to elements of the cooling receiver as those of the aforementioned embodiment shown in FIGS. 2 and 3, and a detailed description thereof is omitted and only differences are described.

Referring to FIGS. 7, 8, and 9, a receiver unit 54 may include a plurality of cooling units 51. In the present embodiment, the receiver unit 54 includes two cooling units 51.

A first inlet flow channel 52*a* and a second inlet flow channel 53*a* are disposed at the lower parts of the cooling units 51, respectively. A pipe that is part of the suction flow channel 26*a* of the second evaporator 26, and corresponds to a portion between the second condenser 23 and the cooling receiver 50, may be branched into two pipes, and may be connected to the first inlet flow channels 52*a*, respectively. The heat recovery liquid line 34 may be branched into two lines and connected to the second inlet flow channels 53*a*, respectively.

The first outlet flow channel 53*b* may penetrate the upper end of the receiver unit 54 and may be branched into two flow channels within the receiver unit 54. The two flow channels may be connected to the second refrigerant flow channels 53, respectively.

As described above, the air conditioner and the cooling receiver of the air conditioner according to embodiments of the present disclosure can have a simpler (which is also less costly) and more compact structure, as well as improved refrigeration efficiency because the supercooler and the receiver are integrated.

The technical advantages of the present invention are not limited to the aforementioned advantages and other technical advantages that have not been described will be evidently understood by those skilled in the art from the following description. Those skilled in the art to which the present invention pertains will understand that the present invention may be implemented in other various forms without departing from the technical spirit or essential characteristics of the present invention. Accordingly, the aforementioned embodiments should be construed as being only illustrative not being limitative from all aspects. Furthermore, the scope of the present invention is defined by the appended claims rather than the detailed description. It should be understood that all modifications or variations derived from the meanings and scope of the present invention and equivalents thereof are included in the scope of the appended claims.

What is claimed is:

1. An air conditioner, comprising:

an air-conditioning cycle comprising a first compressor, a first condenser, a first expansion device, and a first evaporator, the air-conditioning cycle having a first refrigerant circulating therethrough;

a refrigeration cycle circuit comprising a second compressor, a second condenser, a second expansion device, and a second evaporator, the refrigeration cycle having a second refrigerant circulating therethrough; and a cooling receiver to thermally exchange the first and second refrigerants respectively passed through the first and second condensers, the cooling receiver to store the thermally exchanged second refrigerant, wherein the cooling receiver comprises:

a cooling unit comprising a plurality of first refrigerant flow channels through which the second refrigerant passed through the second condenser flows and a second refrigerant flow channel which surrounds an outer circumference of part of the plurality of first refrigerant flow channels and through which the first refrigerant passed through the first condenser flows and supercools the second refrigerant flowing through the plurality of first refrigerant flow channels; and a receiver unit accommodating an upper portion of the cooling unit and storing the supercooled second refrigerant exiting from the plurality of first refrigerant flow channels, the air conditioner further comprising:

a first inlet flow channel to supply the plurality of first refrigerant flow channels with the second refrigerant passed through the second condenser, the first inlet flow channel being connected to the plurality of first refrigerant flow channels through the second refrigerant flow channel;

a second inlet flow channel to supply the second refrigerant flow channel with the refrigerant passed through the first condenser, the second inlet flow channel being connected to the second refrigerant flow channel;

a first outlet flow channel to have the refrigerant passed through the second refrigerant flow channel to exit, the first outlet flow channel being connected to an upper portion of the second refrigerant flow channel through an upper surface of the receiver unit and to a suction flow channel of the first compressor; and a second outlet flow channel to have the supercooled second refrigerant stored in the receiver unit exit the receiver unit, the second outlet flow channel being connected to the receiver unit and to a suction flow channel of the second evaporator, wherein a lower portion of the cooling unit is protruded from a lower surface of the receiver unit, wherein:

the first inlet flow channel and the second inlet flow channel are disposed at the lower portion the cooling unit; and the second outlet flow channel is disposed at the lower surface of the receiver unit;

wherein:

upper ends of the plurality of first refrigerant flow channels disposed inside the receiver unit are open, an upper surface of the second refrigerant flow channel disposed inside the receiver unit is closed, and the upper ends of the plurality of first refrigerant flow channels are protruded from the upper surface of the second refrigerant flow channel.

2. The air conditioner of claim 1, wherein:

the receiver unit comprises a cap to shield an upper end of the receiver unit, and the first outlet flow channel penetrates the cap.

3. The air conditioner of claim 1, further comprising:

an air-conditioning liquid line to connect the first condenser and the first evaporator;

a heat recovery liquid line to connect the air-conditioning liquid line and the second inlet flow channel;

a heat recovery expansion device to expand the refrigerant passed through the first condenser, the heat recovery expansion device being provided at the heat recovery liquid line; and a heat recovery line to connect the suction flow channel of the first compressor and the first outlet flow channel.

4. The air conditioner of claim 3, further comprising:

a heat recovery liquid line valve to open/shut the heat recovery liquid line, the heat recovery liquid line valve being provided in the heat recovery liquid line; and at least one heat recovery line valve to open/shut the heat recovery line, the at least one heat recovery line valve being installed in the heat recovery line.

5. The air conditioner of claim 1, further comprising at least one mounting bracket provided at the receiver unit.

6. The air conditioner of claim 5, wherein the at least one mounting bracket comprises:

a circular main body unit that surrounds an outer circumferential surface of the receiver unit, and a plurality of mounting units provided at the outer circumferential surface of the main body unit, wherein the plurality of mounting units extend downward from the main body unit, and lower ends of the plurality of mounting units are bent outward.

7. The air conditioner of claim 1, wherein the cooling unit comprises a plurality of the cooling units.

8. The air conditioner of claim 1, further comprising:

a cooling/heating switching valve to switch between a cooling operation and a heating operation, the cooling/heating switching valve being connected to the first compressor, the first condenser, and the first evaporator.

9. The air conditioner of claim 1, wherein the first expansion device comprises a first expansion valve and a second expansion valve, whereby the first expansion valve is located closer to the first condenser than the second expansion valve, and the second expansion valve is located closer to the first evaporator than the first expansion valve.

* * * * *